US005581919A

United States Patent [19]

Torma et al.

[11] Patent Number: 5,581,919

[45] Date of Patent: Dec. 10, 1996

[54] STEAM-GENERATING DEVICE

[75] Inventors: Mikael Torma, Gunzgen; Pius Poredos, Rothenburg, both of Switzerland

[73] Assignee: Jura Elektroapparate AG, Niederbuchsiten, Switzerland

[21] Appl. No.: 383,315

[22] Filed: Feb. 3, 1995

[30] Foreign Application Priority Data

Feb. 4, 1994 [CH] Switzerland ..... 322/94

[51] Int. Cl.[6] ..... D06F 75/10; F22B 27/16

[52] U.S. Cl. ..... 38/104; 68/222; 122/11

[58] Field of Search ..... 38/16, 1 A, 77.1, 38/77.5, 77.83, 77.8, 107, 104; 392/386, 394, 399; 223/51, 70, 76; 122/11, 29, 508; 237/67; 417/207, 208; 68/222

[56] References Cited

U.S. PATENT DOCUMENTS

| | | | |
|---|---|---|---|
| 3,051,144 | 8/1962 | Huettner | 122/11 |
| 3,799,120 | 3/1974 | Huettner | 122/11 |
| 4,125,953 | 11/1978 | Colombo | 38/77.83 X |
| 4,866,859 | 9/1989 | Kopelman | 38/77.81 X |

FOREIGN PATENT DOCUMENTS

| | | |
|---|---|---|
| 0233535 | 8/1987 | European Pat. Off. . |
| 0244538 | 11/1987 | European Pat. Off. . |
| 0523489 | 1/1993 | European Pat. Off. . |
| 2447458 | 8/1990 | France . |
| 522886 | 4/1931 | Germany . |

*Primary Examiner*—Ismael Izaguirre

*Attorney, Agent, or Firm*—Oblon, Spivak, McClelland, Maier & Neustadt, P.C.

[57] ABSTRACT

A device includes a heating body and a steam-chamber head which form the housing for a steam chamber. The inside walls of the heating body and of the steam-chamber head form an annular steam chamber. An impeller is disposed in the steam chamber as a rotary component. Via a feed supply line, water is supplied to the steam chamber in the vicinity of the vanes of the impeller. By way of the rapidly rotating impeller, the water is atomized into tiny droplets and reaches the hot wall of the steam chamber, where the droplets are vaporized. Good heat transmission and quick evaporation are made possible, i.e., a large amount of steam can reach the consuming appliance via a steam connection within a short time. The scale deposited can easily be removed.

14 Claims, 5 Drawing Sheets

Fig. 6
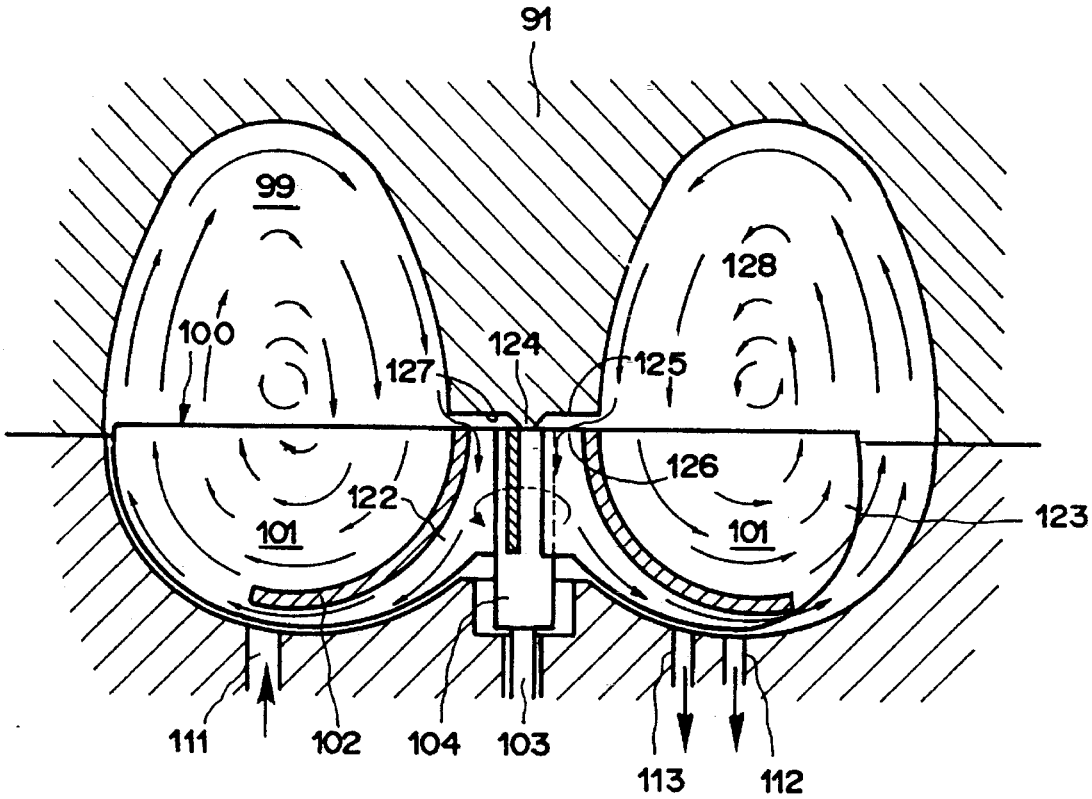
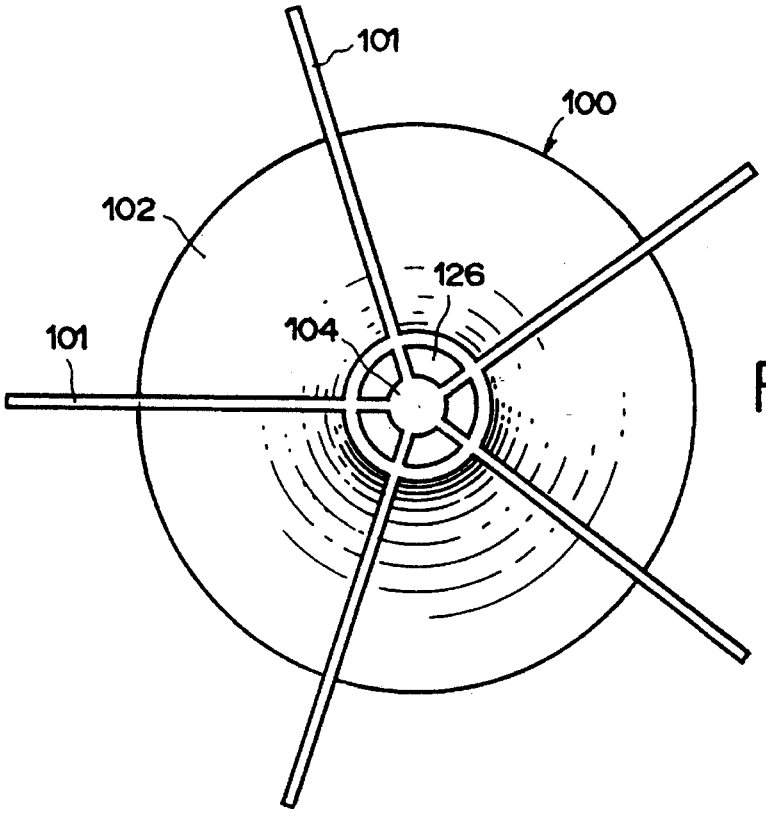
Fig. 7

STEAM-GENERATING DEVICE

BACKGROUND OF THE INVENTION

1. Field of the Invention

This invention relates to devices for producing steam, and more particularly to a steam-generating device of the type having a housing, a steam chamber, a heating arrangement, a water feed line, at least one steam-discharge line, and at least one rotating means disposed in the steam chamber for atomizing the water and for flinging the same against the steam-chamber wall. The invention further relates to an arrangement having such a steam-generating device and intended for an iron used with an ironing-board.

2. Discussion of the Background

In prior art devices for generating steam, the transmission of heat to the droplets of water, and thus the efficiency, are insufficient. Existing devices are very large relative to the steam output.

SUMMARY OF THE INVENTION

It is an object of this invention to provide an improved steam-generating device by means of which the drawbacks of the prior art are avoided and which has greater efficiency than prior art devices.

A further object of the invention is to provide a steam-generating device which generates a very large amount of steam in a small space within a short time.

Still another object of the invention is to provide a steam-generating device whereby scale is deposited largely in the form of powder and well distributed.

To this end, in the steam-generating device according to the present invention, of the type initially mentioned, the wall of the steam chamber is heated at least partially by the heating arrangement, and the steam chamber is annular.

One advantage of the inventive device is that it can be operated in any position.

In the arrangement according to the present invention of the type initially mentioned, the steam-generating device is disposed in the region of the ironing-board, and the steam-discharge line is connected to the iron.

BRIEF DESCRIPTION OF THE DRAWINGS

Preferred embodiments of the invention will now be described in detail with reference to the accompanying drawings, in which:

FIG. 6 is a section through the steam chamber of the device of FIG. 5, and FIG. 7 is a top plan view of the impeller.

DESCRIPTION OF THE PREFERRED EMBODIMENTS

Figure 1:
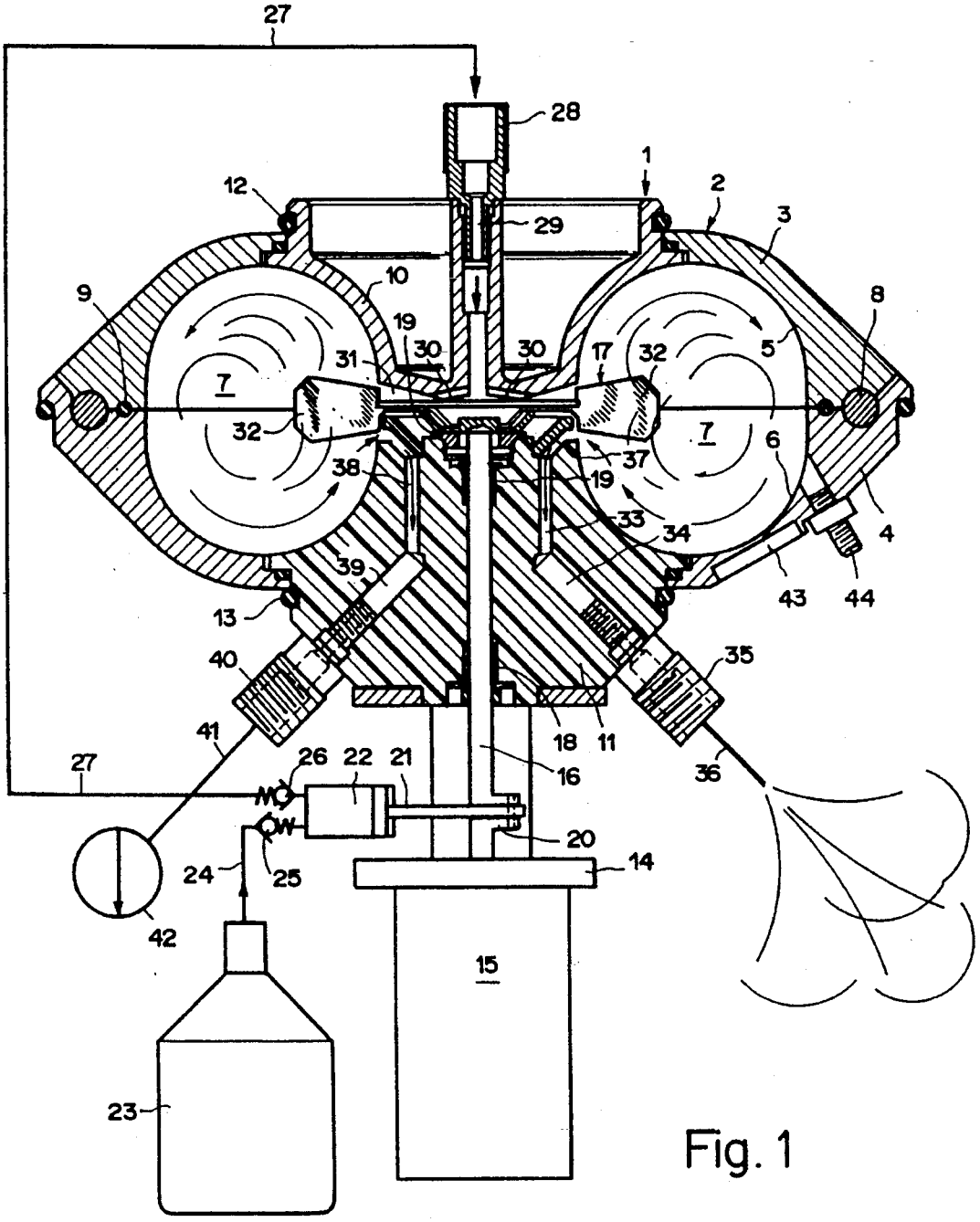
FIG. 1 is an elevation, partially in section, of a steam-generating device in a first embodiment of the invention.

In a first embodiment of the invention illustrated in FIG. 1, a steam-generating device 1 has an axially symmetrical body 2 comprising on the outside two contiguous heat shells

3 and 4, the inside walls 5 and 6 of which bound an annular steam chamber 7. Disposed at the interface between shells 3 and 4 is a likewise annular heating body 8, a gasket 9 of temperature-stable material, e.g., silicone, being disposed between body 8 and chamber 7. Shells 3 and 4 are made of a material which is a good conductor of heat, e.g., aluminum. Adjacent to upper heat shell 3, as viewed in the drawing, is an upper part 10 of axially symmetrical body 2, made of a poor conductor of heat, e.g., heat-resistant plastic. Adjacent to lower heat shell 4, as viewed in the drawing, is a lower part 11, also made of a poor conductor of heat such as heat-resistant plastic. The two heat shells 3 and 4 plus upper part 10 and lower part 11 surround annular steam chamber 7, which may be circular, elliptical, oval, or egg-shaped in cross-section. Heat shells 3 and 4, made of a good conductor of heat, viz., aluminum, conduct the heat from heating body 8 to the wall 5, 6 of steam chamber 7.

Body 2 is held together by steel rings 12 and 13. Via a shaft 16, an electric motor 15 secured to a flange 14 drives an impeller 17 extending into steam chamber 7. Shaft 16 is mounted at the bottom in bearings 18 and 19 and at the top on lower part 11. Via a crank gear 20, motor 15 drives the piston rod 21 of a cylinder pump 22. From a water reservoir 23, pump 22 pumps water through a first line 24 and a first valve 25, then through a second valve 26 and a second line 27, to a connection piece 28 on upper part 10 of device 1. Through a duct 29 in connection piece 28, the water flows via ducts 30 to the center of the rotating impeller 17 and onto the vanes 32 thereof. The water, atomized into tiny droplets, is flung outward by centrifugal force against the hot wall 5, 6 of steam chamber 7, where it is vaporized. The rotation of impeller (fan wheel) 17 generates a turbulent movement of air in the heated steam chamber 7. The additional air current in chamber 7 augments the uniform distribution of the water on the hot wall of the chamber and brings about optimum exploitation of the thermal energy present, as well as generation of a maximum amount of steam.

The steam is supplied through a space 31, two bores 33 and 34, and a coupling 35 via a connecting line 36 to the consuming appliance, e.g., an iron. A plastic part 37 keeps steam from flowing into the region around the end of shaft 16. Through two bores 38 and 39, steam is supplied via a connection 40 and a line 41 to a manometer 42, for example, or to a second consuming appliance. In the case of this steam supply line, plastic part 37 likewise keeps steam from flowing into the region around the end of shaft 16. A thermostat may be inserted in a recess 43 and secured by means of a fixing screw 44.

Figure 2:
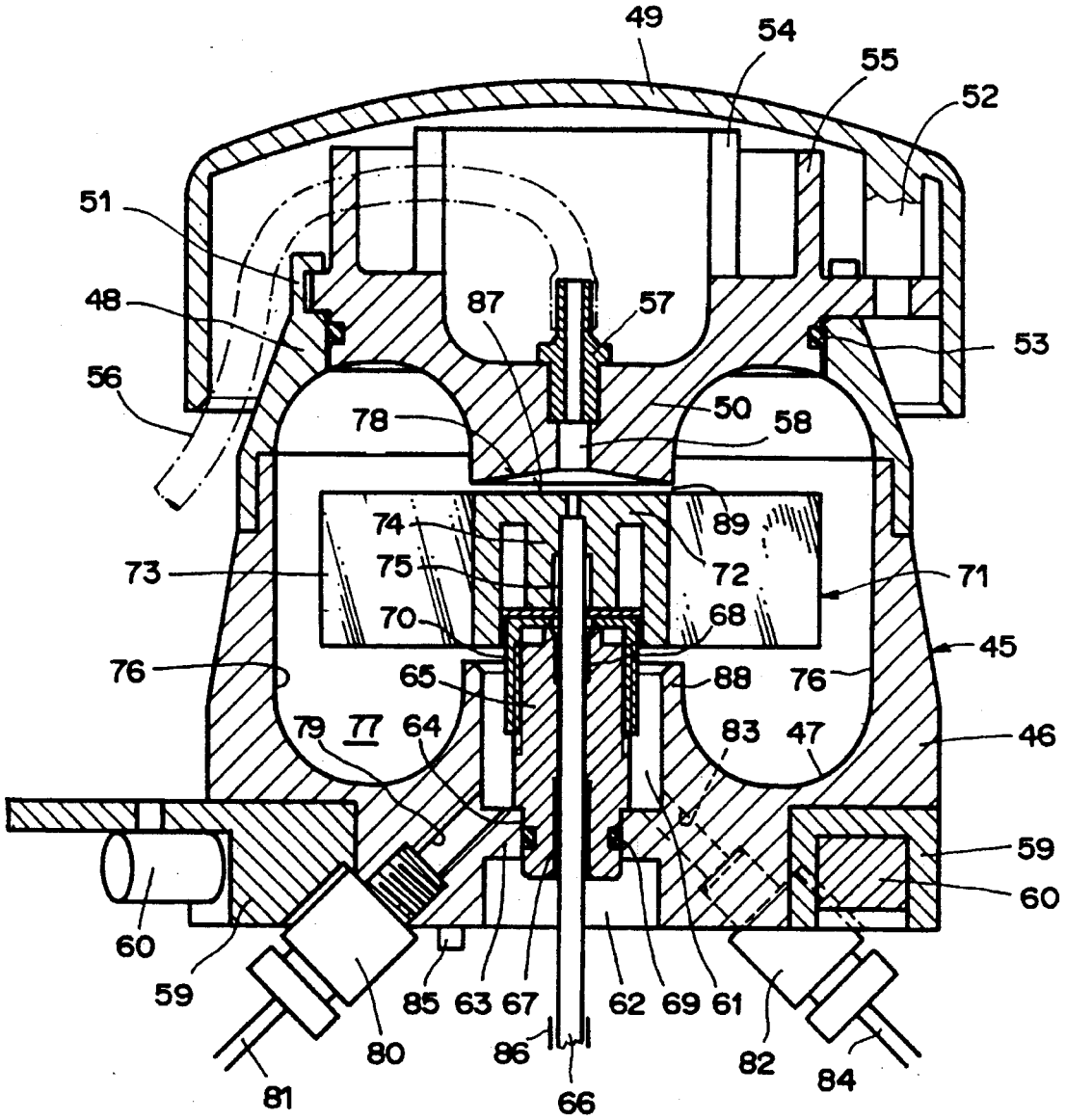
FIG. 2 is a cross-section of a steam-generating device in a second embodiment of the invention.

In the second embodiment of the invention illustrated in FIG. 2, a steam-generating device 45 is also axially symmetrical. It comprises, as viewed in FIG. 2, a lower part 46 made of a good conductor of heat, e.g., aluminum, having an annular cavity 47. Next is a middle part 48 which is joined to lower part 46 and is likewise made of a material such as aluminum which conducts heat well. Attached to part 48 by means of a bayonet catch 51 is a cover 49 having an extension piece 50 joined thereto. Cover 49 is made of plastic and extension piece 50 of a poor conductor of heat such as a heat-resistant plastic. Piece 50 is secured to a bolt 52 integral with cover 49. Disposed along the outer periphery of extension piece 50 is an O-ring which seals it relative to middle part 48. Facing cover 49 on piece 50 are parts 54 and 55 in the approximate shape of hollow half-cylinders for holding a water supply tube 56 and forming a sort of labyrinth. Tube 56 is connected to an adapter 57 inserted in a bore 58 in extension piece 50.

Pressed into the bottom of lower part 46 is a heating body 60 provided with a jacket 59 made preferably of aluminum.

A conventional, commercially available heating element is used as the heating body 60. Lower part 46 according to FIG. 2 is broadened in its middle section 88, an annular shoulder 63 being provided between upper and lower bores 61, 62. A shaft bearing part 65 for mounting a rotary shaft 66 is inserted in the central opening 64 of annular shoulder 63. Bearing part 65 has two bearings 67 and 68 for mounting shaft 66 and is sealed in annular shoulder 63 by means of an O-ring 69. Placed on bearing part 65 is a gasket cap 70, preferably of plastic. An impeller 71 having a middle part 72 and four vanes 73 secured thereto is mounted on shaft 66. Shaft 66 is inserted in a bore 75 disposed in a central projection 74 of middle part 72.

In the same manner as in the first embodiment, shaft 66 is driven by a motor via a crank gear. The same motor drives a cylinder pump which conveys water from a flexible water reservoir to a water supply tube 56. The water conveyed through tube 56 is supplied via adapter 57 and bore 58 to the center of the disk-shaped middle part 72 of impeller 71, whereupon the rotating middle part 72 flings the water, atomized into tiny droplets, outward against the hot wall 76 of a steam chamber 77 of oval cross-section formed by the inside surfaces of lower part 46, of middle part 48, and of extension piece 50. Only the inside walls of lower part 46 and of middle part 48, both preferably made of aluminum, are heated. The inside surfaces of plastic extension piece 50 are not heated, or only moderately. At the bottom of piece 50 there are four water injection ducts 78 disposed at right angles to one another.

As in the first embodiment, the vanes 73 of impeller 71 cause a turbulent movement of air in the heated steam chamber 77. The additional air current in chamber 77 augments the uniform distribution of the water on the hot wall of the chamber and brings about optimum exploitation of the thermal energy present, as well as generation of a maximum amount of steam. The steam is supplied via steam-outlet ring 61 and a duct 79 to a coupling 80 and through a tube 81 to the consuming appliance, e.g., an iron. A second coupling 82 may also be provided, with steam being supplied to it from steam-outlet ring 61 via a duct 83. From coupling 82, the steam is conveyed over a line 84 to a manometer or further consuming appliances (not shown). A temperature sensor 85 may additionally be provided on the underside of lower part 46.

Impeller 71, disposed at a very short distance 89 from the bottom of extension piece 50, has two functions, viz., centrifuging the water droplets by means of the disk-shaped surface 87 of the middle part 72 which acts as a centrifuge surface, and acceleration of the air by means of vanes 73. Drive shaft 66 for impeller 71 is, for example, connected via a coupling 86 to the drive shaft of the motor (not shown).

A flexible plastic recipient is preferably used as the water reservoir (not shown). The advantage of this is that the water reservoir is capable of functioning in any position since atmospheric pressure presses it together, which is not the case for a rigid container if it is upside down, for instance. The steam-generating device is intended to be of a portable design and usable in any position. The device can be controlled by having the pump convey more water or less, and the impeller rotate faster or slower, according to the voltage. Heat can be accumulated on the heated steam-chamber wall 76, so that a large quantity of steam can be drawn at short notice. The thermal energy can be withdrawn very quickly by the device having an impeller. In a pressure-tank system, the temperature or the pressure would have to be increased to such an extent that this would be critical for the system. Using the present steam-generating device, e.g., for an iron, the steam is drawn pulsatingly, but not under the increased pressure which would be necessary for a conventional pressure tank. In the inventive device, water is supplied virtually at atmospheric pressure, the heat being accumulated in the housing 3, 4 or 46, 48.

Instead of the water recipient, a fixed water connection with a pressure-reduction valve might be used instead, which would also make it possible to use the steam-generating device in any position. The water connection could be opened and closed by means of a magnetic valve.

One advantage of the second embodiment as compared with the first is the removable cover, which makes descaling easier. The inventive steam-generating device can be opened immediately after use since there is no overpressure.

Figure 3:
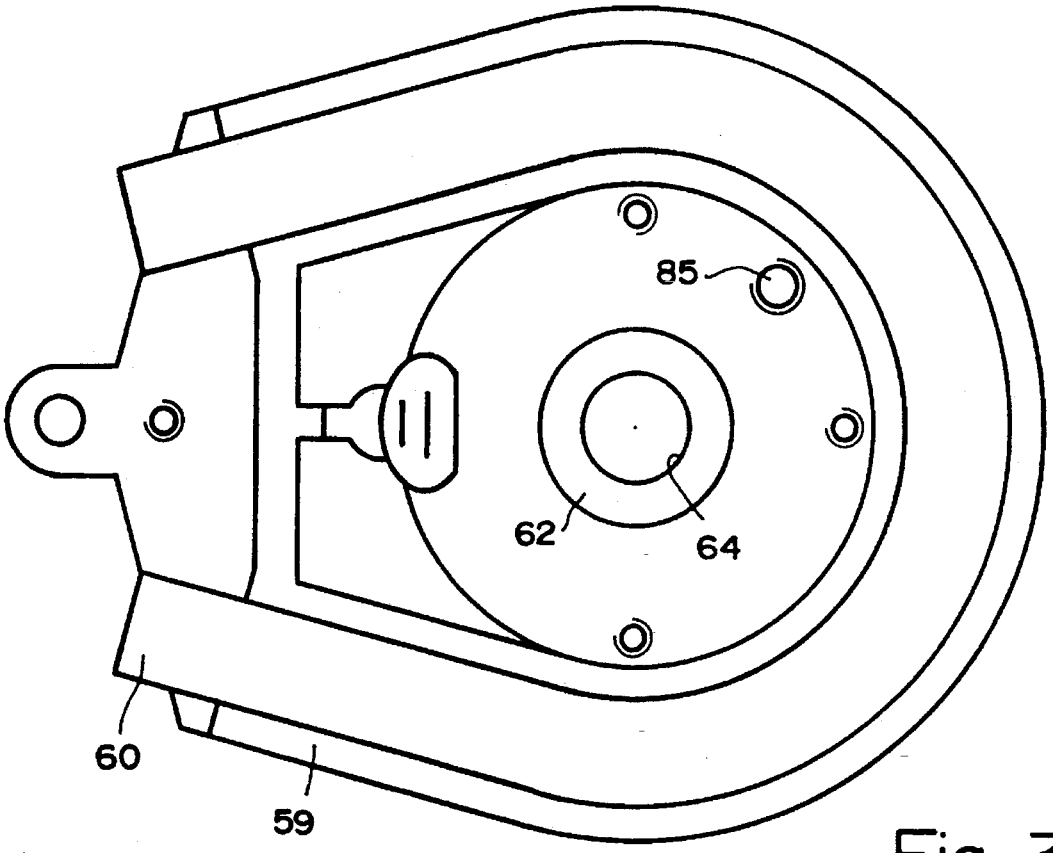
FIG. 3 is bottom view of a heating means.
Figure 4:
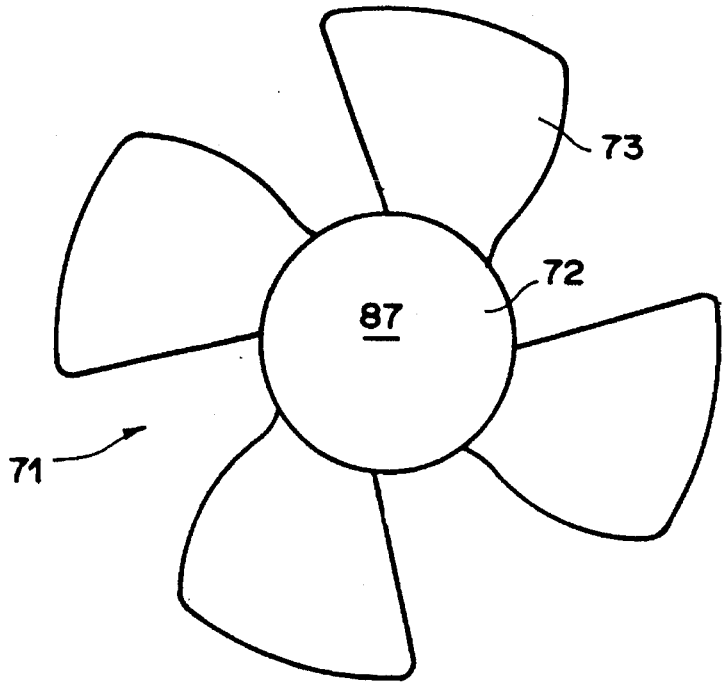
FIG. 4 is a top plan view of an impeller.

FIG. 3 shows the heating arrangement from below, while FIG. 4 shows the impeller with its middle part having a plane or structured centrifuging surface 87 and the adjoining four vanes 73. Fewer or more vanes might also be provided.

Figure 5:
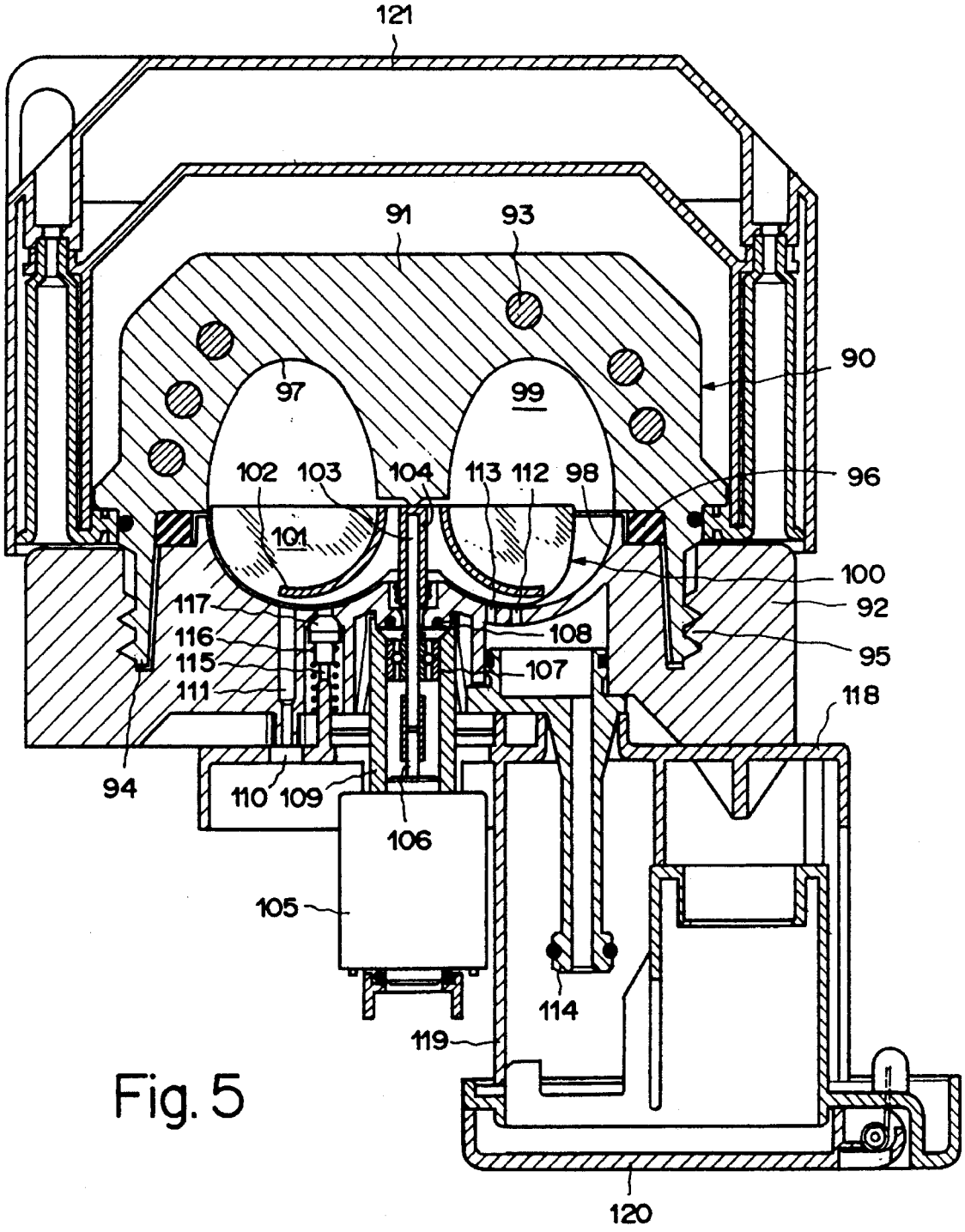
FIG. 5 is a section through a steam-generating device in a third embodiment of the invention.

FIG. 5 shows a section through a steam-generating device 90 in a third embodiment of the invention. Device 90 comprises a heating body 91 and a steam-chamber head 92. A heating coil 93 is disposed in body 91, which has a projecting cylindrical rim 94 provided on the outside with a thread 95 by means of which heating body 91 is screwed into steam-chamber head 92. Body 91 and steam-chamber head 92, between which a gasket 96 is disposed, constitute the housing for a steam chamber 99 formed by the inside steam-chamber wall 97 of body 91 and the inside steam-chamber wall 98 of steam-chamber head 92. An impeller 100 is disposed in chamber 99 as a rotary means. Impeller 100 may have five substantially semicircular vanes 101 and a middle part 102, for example, and is driven via a shaft extension 103, engaging a hub 104, by a motor 105 having a shaft 106. Shaft extension 103 is held by a shaft-support bearing 107 and provided with a shaft-sealing device 108. Motor 105 is disposed in steam-chamber head 92 by means of a motor bearing spacer 109.

Water is supplied to steam chamber 99 in the vicinity of vanes 101 via a water connection 110 through a bore 111 in steam-chamber head 92. Connection 110 may be connected to a pump and the pump to a water reservoir. Bore 111 serves as a water feed. The water is atomized by the rapidly rotating impeller 100 into tiny droplets and reaches the hot steam-chamber wall 97, 98, where the droplets are vaporized. The droplets rotate both about the center line of steam chamber 99 and about the drive shaft and its imaginary extension for impeller 100. The droplets are thereby thoroughly mixed and can evaporate quickly, i.e., a great deal of steam can reach the consuming appliance within a short time. Through two bores 112 and 113 near vanes 101 disposed opposite water-intake bore 111 relative to shaft 103, 106, the steam reaches a steam connection fitting 114 and, through a tube connected thereto (not shown), to the consuming appliance. Bores 111, 112, 113 are disposed at the broader (cross-sectional) end of steam chamber 99. Further provided is an overpressure regulator 115 having a spring 116 and a valve ball 117. A holding plate 118 is joined to a socket 119, having a hinged lid 120, for a steam-connection plug (not shown). Double-walled heat insulation 121 is provided over heating body 91.

FIG. 6 illustrates steam chamber 99 and impeller 100 in detail. In the present case, annular chamber 99 has a somewhat egg-shaped cross-section. Instead, however, it might be circular, elliptical, or oval, for example. Arrows indicate the direction of movement of the water droplets or steam. Curved middle part 102 of impeller 100 divides vanes 101 into a shaft-adjacent part 122 and a shaft-remote part 123.

Hub 104 of impeller 100 lies on the conical central portion 124 of the middle part 125 of heating body 91. Between the end face of part 125 and the end region 126 of impeller 100 is a gap through which steam flows from the portion 128 of chamber 99 remote from impeller 100 into the shaft-adjacent part 122 of impeller 100.

FIG. 7 is a top plan view of impeller 100.

In the inventive device, cleaning is facilitated by the fact that scale is largely deposited in powder form owing to atomization of the water by the air current and centrifugal force.

Steam can be generated in any position with the inventive device, thus facilitating portable operation. Hence the device can also be used for steam cleaning, for example, in which case the steam-generating device can be slung on. The amount of steam may be continuously regulated via control from the appliance (iron, steam cleaner, etc.).

The stem-generating device may be used, among other things, for an iron. It is then preferably disposed in the area of the ironing board, with a steam-discharge line being connected to the iron.

What is claimed is:

1. A steam-generating device comprising:

a housing which includes a steam chamber having a wall;

a heating means;

a water feed line for providing water into said steam chamber;.

at least one steam-discharge line; and at least one rotary means disposed in said steam chamber for atomizing water and flinging it against said wall, said wall being at least partially heated by said heating means, and said steam chamber being annular.

2. The device of claim 1, wherein said rotary means is an impeller.

3. The device of claim 2, wherein said impeller comprises a plurality of vanes and a center part connected to said vanes and including a centrifuging surface.

4. The device of claim 3, wherein said vanes are semi-circular.

5. The device of claim 3, wherein said water feed line opens into said steam chamber in a vicinity of said vanes.

6. The device of claim 3, wherein said impeller comprises a middle part dividing said vanes into two areas.

7. The device of claim 1, wherein said steam chamber is axially symmetrical.

8. The device of claim 1, wherein said means for heating is disposed in a portion of said housing at least partially bounding said steam chamber.

9. The device of claim 1, further comprising a motor for driving said rotary means and a pump for conveying water into said steam chamber.

10. The device of claim 1, further comprising a water reservoir, a pump for conveying water from said reservoir into said steam chamber, and a driving motor for driving said pump and said rotary means.

11. The device of claim 1, further comprising a cover for closing and opening said steam chamber.

12. The device of claim 1, further comprising a flexible water recipient for supplying said device with water.

13. A steam-generating device comprising:

a housing which includes a steam chamber having a wall;

a heating means;

a water feed line for providing water into said steam chamber;

at least one steam-discharge line;

at least one rotary means disposed in said steam chamber for atomizing water and flinging it against said wall, said wall being at least partially heated by said heating means, and said steam chamber being annular; and a plurality of water injection ducts disposed in a portion of said housing projecting into a region of said rotary means.

14. A steam generating device comprising:

a body which includes at least one steam chamber having inside walls;

heating means for heating at least the inside walls of said at least one steam chamber;

a rotary impeller rotatably mounted in said body, said rotary impeller having at least one vane which is disposed in said at least one steam chamber; and water feed means for feeding water to a center portion of said rotary impeller and radially outward onto said at least one vane for atomizing water, such that a rotation of said rotary impeller flings said water against said inside walls heated by said heating means so as to vaporize the water, and the rotation of said rotary impeller causes said at least one vane to generate a turbulent movement of air in said steam chamber to permit a uniform distribution of water on the heated inside walls.

* * * * *